United States Patent [19]

England

[11] 4,108,198

[45] Aug. 22, 1978

[54] MULTIROTARY ENERGY CONVERSION VALVE

[76] Inventor: Will Clarke England, 7310 Eastcrest Dr., Austin, Tex. 78752

[21] Appl. No.: 653,573

[22] Filed: Jan. 29, 1976

Related U.S. Application Data

[63] Continuation-in-part of Ser. No. 466,874, May 2, 1974, Pat. No. 4,044,562, and a continuation-in-part of Ser. No. 467,482, May 2, 1974, abandoned.

[51] Int. Cl.[2] ..... G05D 7/00

[52] U.S. Cl. ..... 137/194; 137/118

[58] Field of Search ..... 418/9, 125, 129, 144, 418/225, 229; 417/252, 440, 251; 137/194, 118

[56] References Cited

U.S. PATENT DOCUMENTS

| | | | |
|---|---|---|---|
| 1,004,776 | 10/1911 | Green | 418/112 X |
| 2,787,224 | 4/1957 | Udale | 418/206 |
| 2,804,260 | 8/1957 | Nilsson et al. | 418/9 X |
| 3,238,738 | 3/1966 | Webber | 417/251 X |
| 3,481,532 | 12/1969 | Fraser | 418/9 |
| 3,535,058 | 10/1970 | Devine | 417/243 X |
| 3,667,874 | 6/1972 | Weatherston | 418/9 |
| 3,692,439 | 9/1972 | Woodling | 418/125 X |
| 3,750,393 | 8/1973 | Minto | 60/682 |

*Primary Examiner*—Allen M. Ostrager

[57] ABSTRACT

A multirotary energy conversion valve comprising inlet and outlet passages interposed by meshing pairs of inlet and outlet rotors of unequal constant volume displacements with an enclosed channel in between for fluid energy conversion with additionally at least one pair of rotors bypassed by a conduit of controlled fractional flow connected to said enclosed channel and additionally heat exchange means included and additionally interposed by meshing intermediate rotors of constant volume displacements with at least one rotary linkage connecting an inlet and an outlet rotor and additionally an intermediate rotor in synchronous rotation about one axis; said valve being applicable in a range including check valves, flow control valves, pressure multiplier and divider valves, thermal fluid drive valves, fluid flow rectifiers, fluid flow amplifiers, vapor flash valves, expansion valves, and reduction valves.

12 Claims, 10 Drawing Figures

1
2
3
4
5
6a
6b
6c
6d
7
8
9
11
12
13
14

MULTIROTARY ENERGY CONVERSION VALVE

This application is a continuation-in-part application of presently co-pending applications Ser. Nos. 466,874 now U.S. Pat. No. 4,044,562 and 467,482 filed May 2, 1974 now abandoned.

SUBJECT MATTER OF THE INVENTION

The invention relates to fluid energy conversion valves and relates more specifically to multirotary valves of linked inlet and outlet stages of unequal constant volume displacements with fluid energy conversion occuring in an enclosed channel with additionally included bypass conduit means of controlled fractional fluid flow, intermediate meshing rotors of constant volume displacements, heat exchange means, rollable sealing and lubricating means and torque output accessibility.

OBJECTS OF THE INVENTION

Valves are utilized for controlling, checking or regulating fluid flow, fluid pressure, fluid velocity and volumetric expansion usually by varying frictional flow characteristics.

It is an object of this Invention to provide a multirotary energy conversion valve of integral interacting elements of such versatility as to be utilizable in any of the aforementioned functions as well as some which are unknown to the art.

Another object of this Invention is to provide an interchange of mechanical torque in a variety of rotary drives set at an almost unlimited range of angles.

A further object of this Invention is to provide a basic multirotary valve of such simplicity and multiplicity that the efficiency of the energy conversions available will approach ideal conditions.

Still another object of this Invention is to provide a fundamental multirotary valve adaptable to a multitude of applications with various appurtenant devices without any substantial alteration in the structure of the multirotary valve.

Other objects and advantages of this Invention will become apparent through consideration of the following description and appended drawings in which:

DETAILED DESCRIPTION OF PREFERRED EMBODIMENT OF INVENTION

Figures 1, 2, 3:
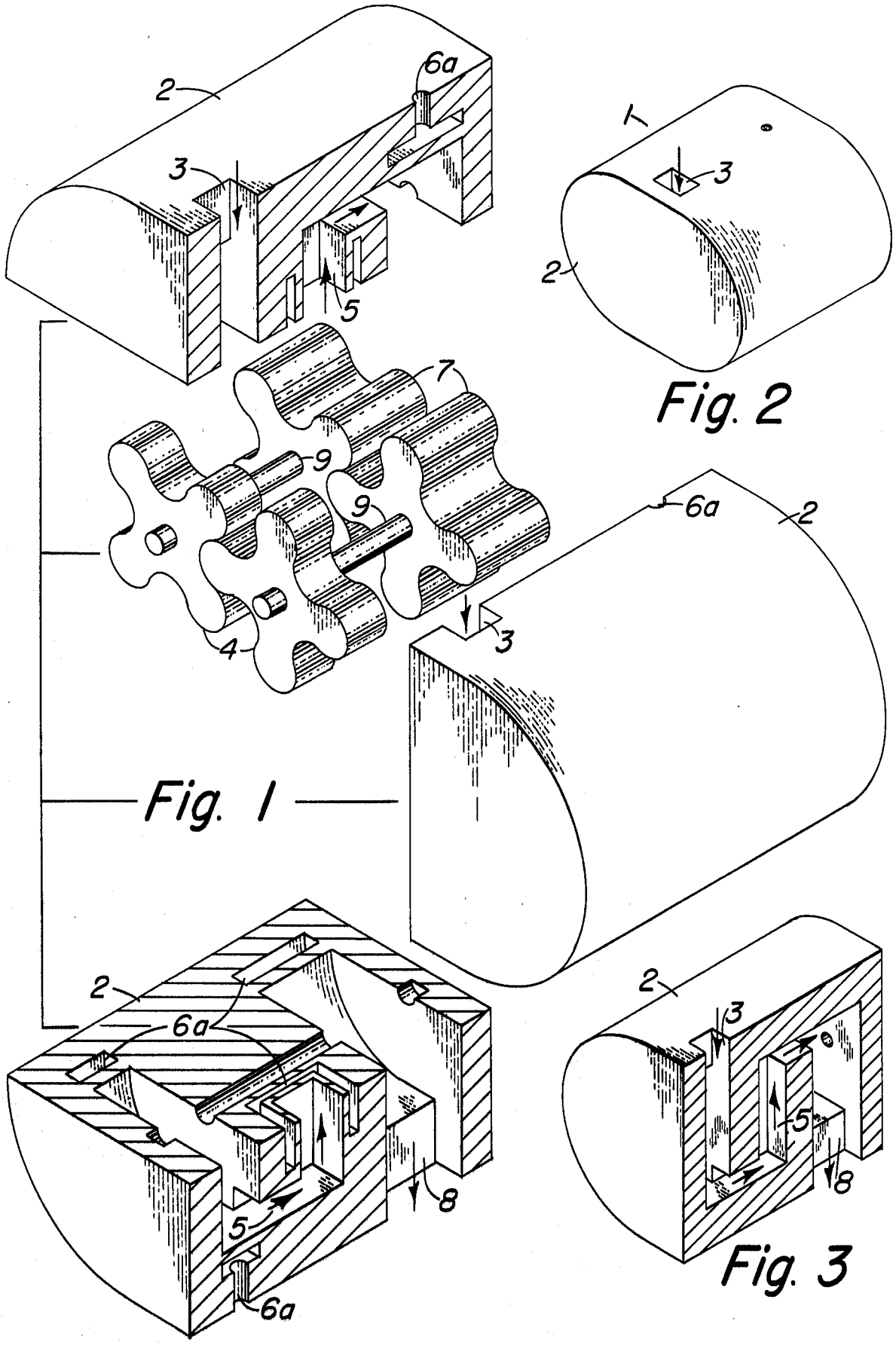
FIG. 1 is an exploded perspective of a parallel axis version of the multirotary valve with inlet rotors having smaller torque characteristics and volumetric displacements than the outlet rotors.
FIG. 2 in a perspective of the parallel axes multirotary valve showing the inlet passage.
FIG. 3 is a sectional perspective of the valve casing showing fluid flow direction.
Figure 4:
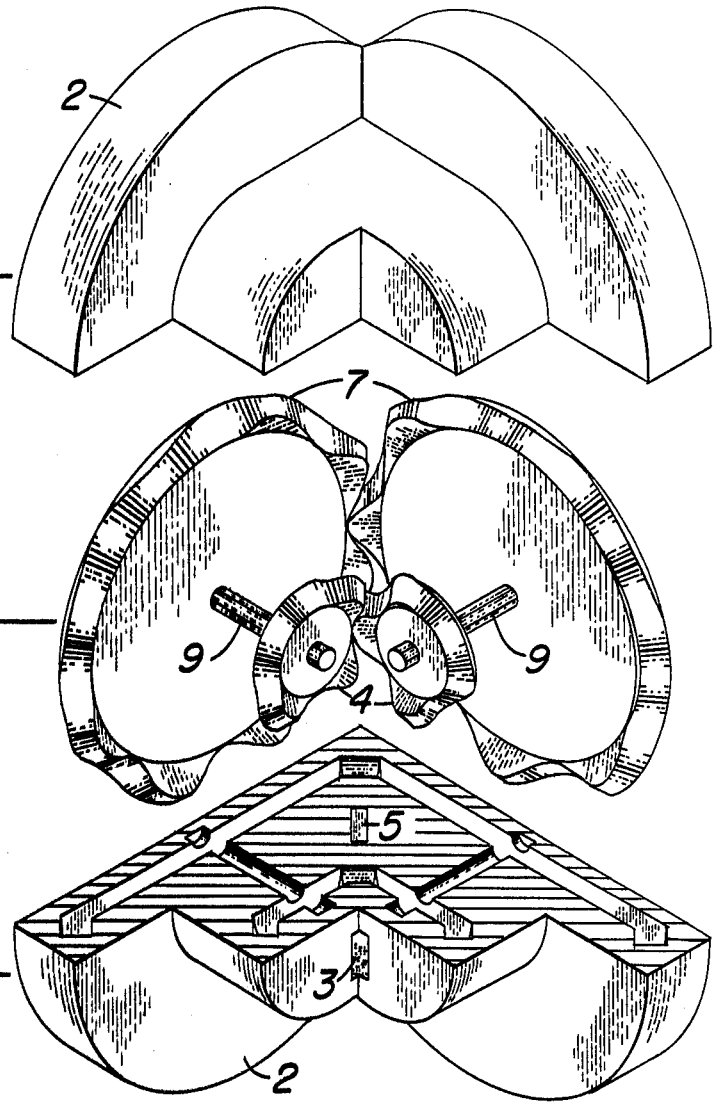
FIG. 4 is an exploded perspective of a variable angle axes version of the multirotary valve with inlet rotors having smaller torque characteristics and volumetric displacements than the outlet rotors.
Figure 5:
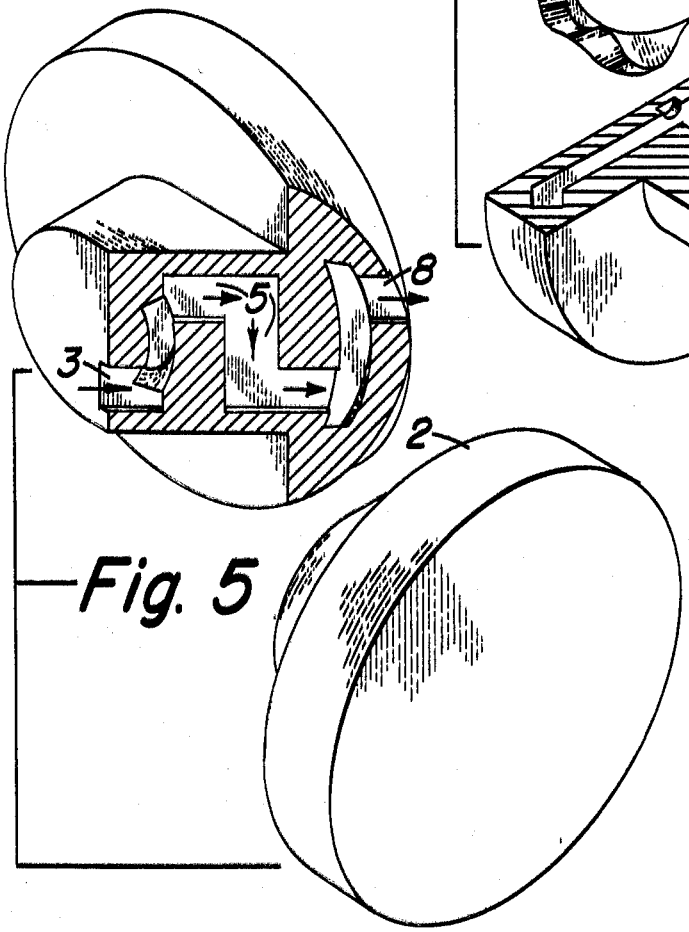
FIG. 5 is a sectioned perspective of the variable angle axes multirotary valve casing showing fluid flow direction.
Figure 6:
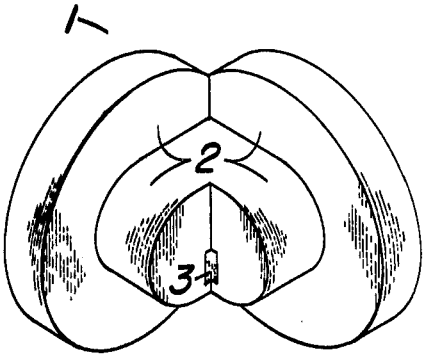
FIG. 6 is a perspective of the variable angle axes multirotary valve.

With reference to the patent drawings, my Invention of a multirotary energy conversion valve 1 for fluids comprises, in general: a valve casing 2; an inlet passage 3 in said valve casing 2, leading to a pair of meshing inlet rotors 4 of constant volume displacements rotatably mounted in said valve casing 2; an enclosed channel 5 in said valve casing 2 leading from said inlet rotors 4 to a pair of meshing outlet rotors 7 of constant volume displacements rotatably mounted in said valve casing 2; an outlet passage 8 in said valve casing 2 leading from said outlet rotors 7; and a rotary linkage 9 drivingly connecting an inlet and outlet rotor in synchronous rotation about one axis. Said valve 1 additionally including heat exchange means *6a;* bypass conduits *6b, 6c* and *6d* with control valve means 11; and rollers 12 with roller seals 13, roller niches 14 and lubricating ducts 15.

The design of the valve casing 2 is mainly a function of the configuration of the rotary elements, however, synthesis of the composite parts of the valve casing 2 is a function of the manufacturing art and machining capabilities. The drawings illustrate some designs of the valve casing 2.

The inlet passage, illustrated by a uniform rectangular cross-section and straight path need not be limited to such a shape since its main function is to convey the fluid from its source to the reappearing volumetric displacement side of the meshing inlet rotors 4 of constant volume displacements.

The pair of meshing inlet rotors 4, fitting snugly in the valve casing 2, convey the fluid from the inlet passage 3 to the enclosed channel 5 via the rotation of the meshing irregular shaped peripheries of the rotors forming moving spaces of constant volumes with the valve casing 2. The meshing irregular peripheries of said rotors should be in continuous and complete meshing contact to prevent leakage of the fluid through the mesh. The irregular peripheries of the rotors preclude the shape of said rotors as regular peripheries which would be completely circular since two contacting cylinders or conics would displace no volume in rotation and would slip instead of mesh. The rotary volumetric displacement being the desired means of conveyance, it is necessary that the meshing inlet rotors be of such continuous mesh and snug fit in said valve casing 2 as to deter any other fluid transit between the inlet passage 3 and the enclosed channel 5 except by the additional bypass conduit *6b.* The rotation of the inlet rotors 4 through the mesh describes a vanishing volumetric displacement side being before the entrance of the irregular shaped peripheries of the inlet rotors 4 into a continuous mesh that precludes volumetric displacement through the mesh to the reappearing volumetric displacement side of the inlet rotors 4.

The enclosed channel 5, basically illustrated by a uniform rectangular cross-section, need not be limited to such a shape nor its illustrated zig-zag path since its main function is to contain the fluid during its energy conversion and allow conveyance of said fluid from the vanishing volumetric displacement side of the inlet rotors 4 to the reappearing volumetric displacement side of the outlet rotors 7 or additionally through the bypass conduits *6b, 6c* and *6d.*

The pair of meshing outlet rotors 7 of constant volume displacements are of the same fundamental characteristics as said meshing inlet rotors 4, but are quantitatively unequal in volumetric displacement per revolution and unequal in torque characteristics. Volumetric displacement per revolution is defined as the product of: a shape coefficient; half the mean pitch of the repeating meshing peripheral irregularities; the width of the rotor meshing peripheral irregularities; the radial depth of the meshing peripheral irregularities; and the number of repeated meshing irregularities. Torque is a function of the pressure on the rotors and the radial area moment where the radial area moment of a rotor is defined as the product of the width of the rotor meshing peripheral irregularities, the radial depth of the meshing peripheral irregularities and the radius from the axis of rotation to the mean circumference of the meshing peripheral irregularities. The mean circumference of the meshing peripheral irregularities is the sum of the mean pitches and is defined as the centerline of the volumetric displacement of each rotor.

The outlet passage 8, illustrated by a uniform rectangular cross-section and straight path, need not be limited to such a shape since its main function is to convey the fluid from the vanishing volumetric displacement side of said meshing outlet rotors 7 to whatever, if anything the multirotary valve 1 is connected.

Additionally the bypass conduits *6b, 6c* and *6d,* basically illustrated by a uniform circular cross-section, need not be limited to such a shape nor its illustrated path since their main function is to convey fractional reversible fluid flow, bypassing at least one pair of meshing rotors to or from said enclosed channel 5 through said bypass conduits with the fractional flow controlled or even stopped by control valve means 11. The inlet bypass conduit *6b* bypasses said pair of inlet rotors 4 connecting said inlet passage 3 with said enclosed channel 5. The outlet bypass conduit *6b* bypasses said pair of outlet rotors 7 connecting said outlet passage 8 with said enclosed channel 5. The bypass conduit *6c* bypasses both inlet and outlet rotors and connects said enclosed channel 5 with other fluid sources or receivers. The control valve means 11 can either be manually or automatically regulated by mechanical or electrical means.

Due to the inequality of the volumetric displacements of the inlet and outlet rotors there is an interaction between the pairs of meshing rotors which is either volumetric expansion or reduction dependent upon which pair of rotors are greater in volumetric displacement. When the volumetric displacements of the inlet rotors 4 are smaller than the outlet rotors 7, the valve is of the expansion mode and a fluid will expand in volume in the enclosed channel 5. When the volumetric displacements of the inlet rotors 4 are greater than the outlet rotors 7, the valve is of the reduction mode and a fluid, if compressible, will reduce in volume in the enclosed channel 5. In the expansion mode a liquid will flash to partial vapor because of the vacuum created, whereas, in the reduction mode a liquid will stop flowing because the larger incoming volume of liquid will not reduce to the smaller outgoing volume, thus the reduction valve becomes a check valve or for reversible conditions of pressure a fluid rectifier. As is obvious from the drawings, the expansion valve is the reverse of the reduction valve and so when the fluid pressures vary to cause reverse of flow, the direction of flow tendency defines which mode of valve is functional. In the expansion mode a gas will expand lowering its temperature and pressure, whereas, in the reduction mode a gas will contract raising its temperature and pressure. The bypass conduits can be used to alleviate or enlarge on the conditions in the enclosed channel 5.

Additionally the heat exchange means *6a* being in thermal communication can be used to alleviate or enlarge on the conditions of temperature and pressure in the enclosed channel 5. Thus addition of heat via the heat exchange means *6a* to the fluid in the enclosed channel 5 of an expansion valve may be used to drive the fluid through the valve by its own expansion, whereas, removal of heat via the heat exchange means *6a* from a gaseous fluid in the enclosed channel 5 of a reduction valve may be used to drive the fluid through the valve by its own contraction.

Additionally a pair of meshing intermediate rotors of the same fundamental characteristics as said meshing inlet rotors 4 and outlet rotors 7 can be included. If said intermediate rotors are of equal volumetric displacement to either the inlet or outlet rotors then such merely serve as secondary sealing inlet or outlet rotors. When the intermediate rotors are of unequal volumetric displacement to both the inlet rotors 4 and the outlet rotors 7, then a multiplicity of basic valves is formed which can be used for expansion or reduction or expansion and reduction in series for high pressure or vacuum operations and even alternating operations.

Figure 10:
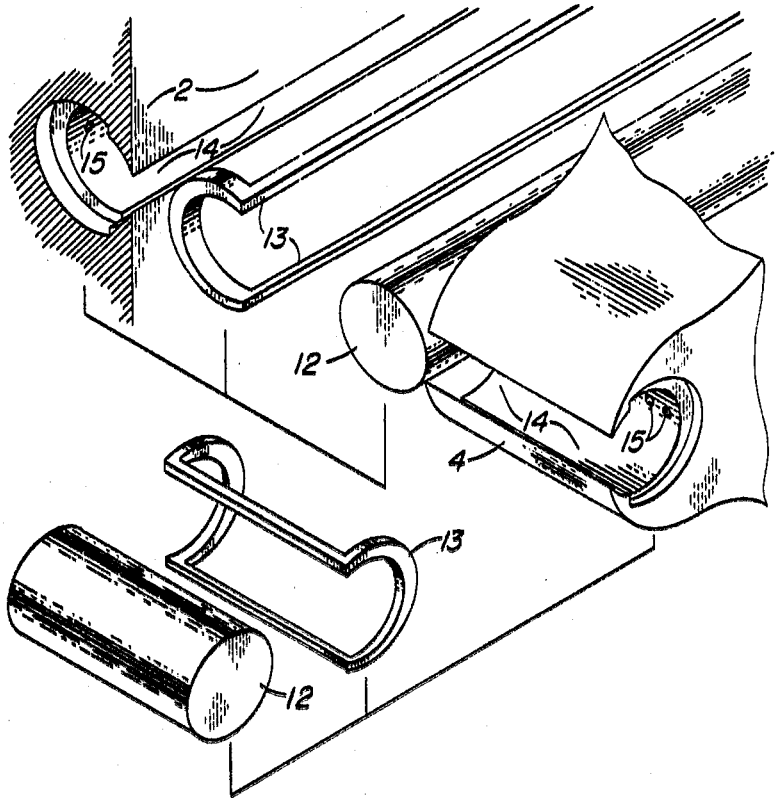
FIG. 10 is an exploded perspective illustrating the sealing and lubricating rollers.

Although sealing and lubricating means are available within the state of the art, this multirotary energy conversion valve is especially adaptable to pure rotary parts which could also include lubricating rolling seals having a bearing capability. FIG. 10 is an illustration of such rollers 12 installed in roller seals 13 which can be inserted in roller niches 14 located in strategic places in the meshing irregular peripheries of the inlet rotors 4 and outlet rotors 7 and in the valve casing 2; rollable on the sides of said rotors along the planes of mesh and between other pressure differentials such as between the inlet passage 3 and the enclosed channel 5 and the outlet passage 8. The rollers 12 in the rotors will roll upon the inner perimeter of the valve casing 2 and upon the meshing irregular peripheries of the rotors themselves in the meshing contact area. The rollers 12 in the valve casing 2 will roll upon the sides of the rotors, but some differential sliding will occur dependent upon the differential speeds along the sides of the rotors or the meshing irregular peripheries. As the rollers 12 are slidably secured in the roller niches 14 by roller seals 13, lubricating ducts 15 can introduce lubrication to the rollers without any losses other than that required by said rollers 12. This could even be insured by multiple roller seals 13, one set within another.

Figures 7, 8, 9:
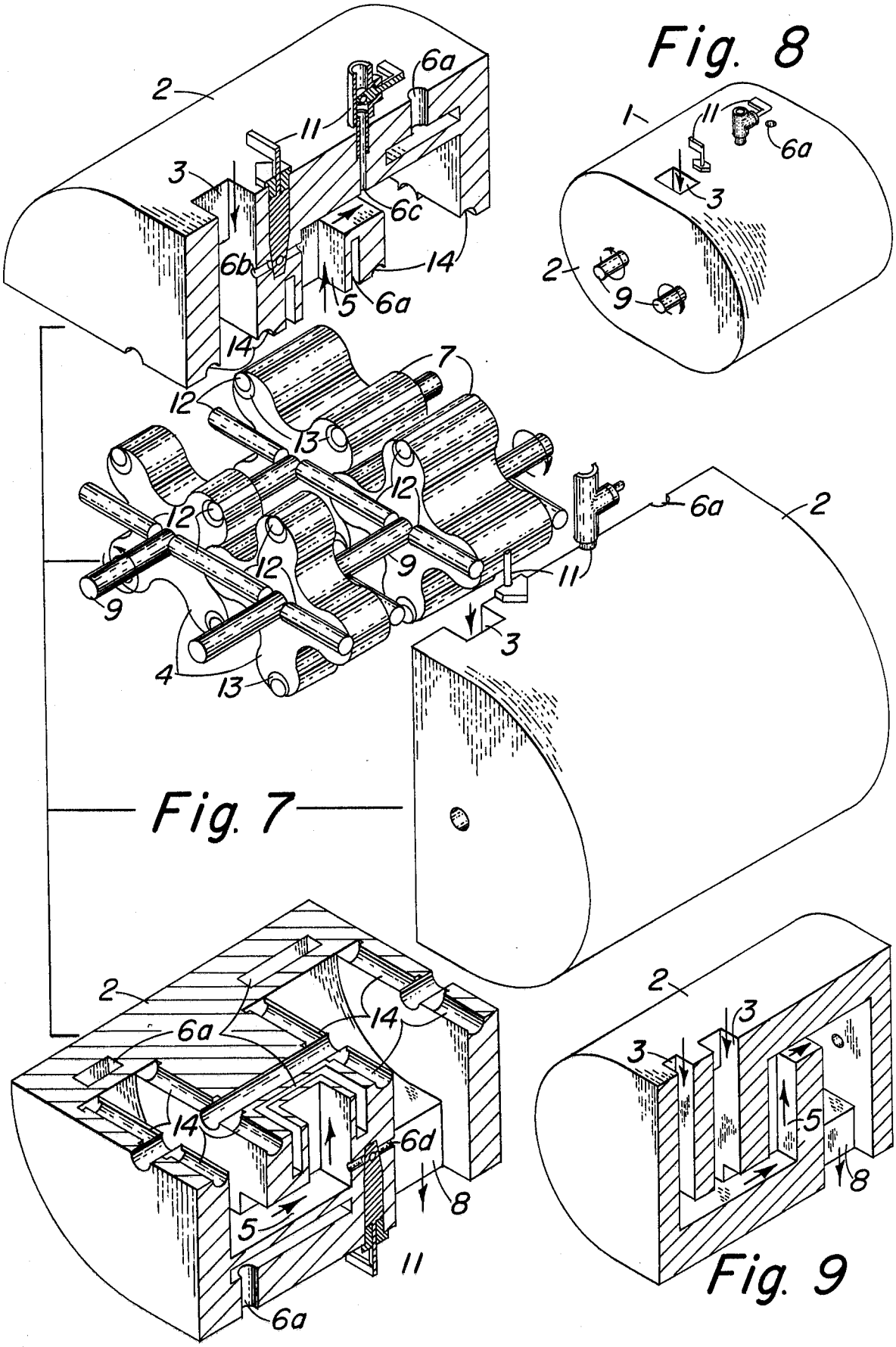
FIG. 7 is an exploded perspective of the parallel axes multirotary valve including bypass controlled conduits, heat exchange means and rollable seals.
FIG. 8 is a perspective of the parallel axes multirotary valve including bypass controlled conduits and heat exchange means.
FIG. 9 is a sectioned perspective of a dual inlet multirotary valve casing showing fluid flow direction.

Also possible within the multiple series of elements are valves such as the mixing valve illustrated in FIG. 9 or the reverse of such which would be a distribution valve.

The rotary linkage 9, basically mounted inside the valve casing 2 and rotatably connecting at least one inlet rotor 4 to one outlet rotor 7 for synchronous rotation about one axis, limits the versatility and use of the multirotary valve 1 to internal fluid and flow alterations and fluid drive. With the rotary linkage 9 accessible externally, the multirotary valve expands in versatility and use to include precision metering of the volumetric flow and for torque output from the potential and kinetic fluid energies. While this accessibility may also allow torque input and thus the old uses of mechanical compression and expansion, such use is not claimed, however, the new and newly useful multirotary valve is claimed.

OPERATION

It is essential to the understanding of this Invention that a single pair of meshing rotors of constant volumetric displacements not be identified with a compressor or vacuum pump unless used in conjunction with a flow resistance mechanism or closed storage, since the constant volumetric displacements only convey the fluid from the reappearing side of the mesh to the vanishing side with no increase or decrease in volume. With the multirotary valve it is only the interaction of the two pairs of meshing rotors of unequal volumetric displacement that produces expansion or reduction in volume. This characteristic even allows the valve some utility in handling liquids.

The adiabatic operation of the multirotary valve 1 can best be understood by considering that one constant volume displacement of the meshing inlet rotors 4 must expand in the enclosed channel 5 to fill a larger constant volume displacement of larger meshing outlet rotors 7 or must contract in the enclosed channel 5 to fit into a smaller constant volume displacement of smaller meshing outlet rotors 7.

In the expansion mode of the basic multirotary valve a thermodynamically reactive fluid such as air or a gas will undergo an increase in pressure and a corresponding increase in temperature, whereas, a liquid such as water will be checked in flow because the lesser outgoing volume will not accommodate the greater incoming incompressible volume and the flow will cease when the internal pressure is sufficient to counter the driving pressure differential.

With the addition of the bypass conduit of fractional reversible flow with control valve means, the liquid flow rectification aspects of the basic valve are enlarged to include amplification of flow control within the limits of rectification and flow capacity of the valve. A reduction valve of this type could with rotary linkage external access replace the hydromechanical or hydroelectric turbine with correspondingly sized control surfaces. Even a very large size reduction valve could have relatively small control valve means to govern water flow and rotor speed and with the additional heat exchange means to boil the water in the enclosed channel, a pumpback capability from a heat source is included. It is even noted that a multirotary valve 1 of amplified response could be utilized as a control valve means 11.

With heat introduced via the heat exchange means, a gas can be expanded in the enclosed channel and thereby input heat energy to provide flow work to cause a fluid to flow through said valve. Such a heat pump with rotary linkage external access becomes also a heat engine with mechanical energy output capability.

With heat removed via the heat exchange means, a gas can be contracted in the enclosed channel and thereby output heat energy to provide flow work to cause a fluid to flow through said valve. Such a cool pump with rotary linkage external access becomes also a cool engine with mechanical energy output capability.

With the addition of an intermediate pair of rotors, the valve can be utilized for sequenced volumetric expansion, reduction or expansion and reduction with flow additionally regulated by bypass conduits with control valve means and with gases additionally acted upon by heat addition or removal via heat exchange means.

The rollers 12, illustrated in FIG. 10, assist in sealing and lubrication of the moving parts of the multirotary valve 1 as well as retaining the pure rotary nature of said moving parts.

The rotary linkages 9, partially illustrated herewith are representative of a whole family of versions similar in operation. Where there are pairs of rotary linkages 9 in a single multirotary valve 1, synchronous meshing and rotation of the meshing rotors could be insured against slip by gear means rotatably connecting said moving parts, but such gear means is not considered as fundamental.

ADVANTAGES

A material advantage of the Invention is the foregoing specification is that it provides a multirotary energy conversion valve having purely rotating parts.

Another advantage of the Invention is that it provides a multirotary energy conversion valve of expansive functional versatility with minimal or even no structural alteration.

A further advantage of the Invention is that it allows a structural versatility heretofore unavailable.

A still further advantage of the Invention is that it provides a multirotary energy conversion valve of minimal moving parts for ease of manufacture, maintenance and repair.

A still further advantage of the Invention is that it provides a multirotary energy conversion valve of amplified response operative over a wide range of rotary speeds and quantitative flow easily governed by manual or automatic control valve means.

A still further advantage of the Invention is that it provides a multirotary energy conversion valve of amplified response of extensive applicability in fluid flow utilization and regulation, and in energy interchange.

Although this Specification describes a multirotary energy conversion valve of multiple applicability, it should be understood that structural or material rearrangement of adequate or equivalent parts, substitution of equivalent functional elements or other modifications in structure can be made and other applications devised without departing from the spirit and scope of my Invention. I, therefore, desire that the description and drawings herein be regarded as only illustrative of my Invention and that the Invention be regarded as limited only as set forth in the following claims or as required by the state of the art.

Having thus described my Invention I claim:

1. A multirotary energy conversion valve for fluids comprising:

(a) a sealed valve casing;

(b) a pair of continuously meshing inlet rotors of constant volumetric displacements in the meshing irregular peripheries of said rotors rotatably mounted in said valve casing;

(c) a pair of continuously meshing outlet rotors of constant volumetric displacements in the meshing irregular peripheries of said rotors rotatably mounted in said valve casing; said outlet rotors having torque characteristics and volumetric displacement rates quantitatively unequal to the torque characteristics and volumetric displacement rates of said inlet rotors;

(d) an inlet passage in said valve casing leading to the reappearing volumetric displacement said of said meshing inlet rotors;

(e) an outlet passage in said valve casing leading from the vanishing volumetric displacement side of said meshing outlet rotors;

(f) an enclosed channel in said valve casing leading from the vanishing volumetric displacement side of said meshing inlet rotors to the reappearing volumetric displacement side of said meshing outlet rotors;

(g) at least one rotary linkage rotatably mounted completely inside said sealed valve casing whereby said rotary linkage does not extend outside of said casing, connecting one inlet rotor and one outlet rotor for synchronous rotation about one axis with said rotary linkage; and (h) said fluid subject to energy conversion in said multirotary energy conversion valve due to the interaction of said meshing inlet rotors and said meshing outlet rotors and said fluid in said enclosed channel whereby there is at least an interchange in the kinetic and potential energies of said fluid.

2. In an energy conversion valve according to claim 1, said pair of inlet rotors having torque characteristics and volumetric displacement rates quantitatively larger than the torque characteristics and volumetric displacement rates of said pair of outlet rotors.

3. In an energy conversion valve according to claim 1, said pair of inlet rotors having torque characteristics and volumetric displacement rates quantitatively smaller than the torque characteristics and volumetric displacement rates of said pair of outlet rotors.

4. In an energy conversion valve according to claim 1, including a heat exchange means for thermal transfer to and from said fluid in said enclosed channel for fluid drive purposes.

5. In an energy conversion valve according to claim 4, including a heat exchange means for thermal transfer to and from said fluid in said enclosed channel for fluid drive purposes.

6. An energy conversion valve as described in claim 2, said energy conversion valve including a heat exchange means for heat removal from said fluid in said enclosed channel whereby a thermodynamically reactive fluid is subject to reduction in temperature and pressure and therefore, increased flow.

7. An energy conversion valve as described in claim 3, said energy conversion valve including a heat exchange means for heat addition to said fluid in said enclosed channel whereby a thermodynamically reactive fluid is subject to an increase in temperature and pressure and therefore, increased flow.

8. In an energy conversion valve according to claim 1, including rollable sealing and lubricating means for insuring closure between the moving and stationary elements.

9. In an energy conversion valve according to claim 8, said rollable sealing and lubricating means being by rotatable rollers slidably secured in niches provided in the meshing irregular peripheries of said inlet and outlet rotors and in said valve casing, rollable on the sides of said rotors along the planes of mesh and between the pressure differentials of said inlet passage, enclosed channel and outlet passage with lubrication introduced in the areas enclosed by slideable seals in contact with said rollers and niches.

10. A multirotary energy conversion valve for fluids comprising:

(a) a completely sealed valve casing;

(b) a pair of continuously meshing inlet rotors of constant volumetric displacements in the meshing irregular peripheries of said rotors rotatably mounted in said valve casing;

(c) a pair of continuously meshing outlet rotors of constant volumetric displacements in the meshing irregular peripheries of said rotors rotatably mounted in said valve casing; said outlet rotors having torque characteristics and volumetric displacement rates quantitatively unequal to the torque characteristics and volumetric displacement rates of said inlet rotors;

(d) an inlet passage in said valve casing leading to the reappearing volumetric displacement side of said meshing inlet rotors;

(e) an outlet passage in said valve casing leading from the vanishing volumetric displacement said of said meshing outlet rotors;

(f) an enclosed channel in said valve casing leading from the vanishing volumetric displacement side of said meshing inlet rotors to the reappearing volumetric displacement side of said meshing outlet rotors;

(g) at least one rotary linkage rotatably mounted completely inside said sealed valve casing whereby said rotary linkage does not extend outside of said casing connecting one inlet rotor and one outlet rotor for synchronous rotation about one axis with said rotary linkage;

(h) said fluid subject to energy conversion in said multirotary energy conversion valve due to the interaction of said meshing inlet rotors and said meshing outlet rotors and said fluid in said enclosed channel whereby there is at least an interchange in the kinetic and potential energies of said fluid; and (i) a conduit of fractional reversible flow in flow communication with said enclosed channel and bypassing at least one pair of meshing rotors, including control valve means for said conduit for conduit flow variable in a range from the difference between the volumetric displacement rates of said inlet and outlet rotors to complete closure whereby said interchange in the kinetic and potential energies of said fluid and said fluid flow is regulated by said control valve means regulation of said fractional flow.

11. In an energy conversion valve according to claim 10, said conduit of fractional reversible flow bypassing said inlet rotors and being in flow communication with said enclosed channel and said inlet passage when said control valve means is open.

12. In an energy conversion valve according to claim 10, said conduit of fractional reversible flow bypassing said outlet rotors and being in flow communication with said enclosed channel and said outlet passage when said control valve means is open.

* * * * *